United States Patent [19]

Pruitt

[11] Patent Number: 4,570,527

[45] Date of Patent: Feb. 18, 1986

[54] BUNDLE DRUM STICK

[76] Inventor: Kenneth W. Pruitt, 4865 Dowing St., Baldwin Park, Calif. 91706

[21] Appl. No.: 656,749

[22] Filed: Oct. 1, 1984

[51] Int. Cl.[4] ..... G10D 13/02

[52] U.S. Cl. ..... 84/422 S

[58] Field of Search ..... 84/422 S

[56] References Cited

U.S. PATENT DOCUMENTS

| | | | |
|---|---|---|---|
| 3,420,134 | 1/1969 | Cordes | 84/422 S |
| 4,114,503 | 9/1978 | Petillo | 84/422 S |
| 4,200,026 | 4/1980 | Phreaner | 84/422 S |

*Primary Examiner*—Lawrence R. Franklin

*Attorney, Agent, or Firm*—Sellers and Brace

[57] ABSTRACT

Disclosed is a percussion musical instrument comprising a drum stick formed of a cluster of wooden rods secured together at one end to provide a handle, the remainder of the rods being free of restraint.

10 Claims, 2 Drawing Figures

BUNDLE DRUM STICK

This invention relates to musical instruments and more particularly to a unique drum stick comprising a cluster of wooden rods secured together at one end to form an operating handle.

BACKGROUND OF THE INVENTION

Percussion musical instruments utilize a variety of beaters one type of which is commonly known as a brush. Such brushes typically are formed of a multiplicity of resilient fine wires secured together at one end with the main length thereof fanned out in a common plane under the constraint provided by the flattened forward end of a tubular handle. Drum beaters of this type are disclosed in the following U.S. Pat. Nos.: namely Goldrich 2,485,322; Goldrich 2,085,823; Goldrich 2,513,930; Sage 3,150,555; Cordes 3,420,134; Calato 4,028,983; and Phreaner 4,200,026. These prior brushes are subject to certain disadvantages and limitations avoided by this invention. For example the musical sounds generated thereby are of such a low level that they are readily masked and over-ridden by the sounds generated by other instruments customarily present when brushes are employed. This drawback is so pronounced that some musical groups must use special microphones and amplifying devices positioned to pick up brush sounds. Such an expedient is subject to limitations in many instances owing to the fact that a sizable group of percussion instruments are often utilized making it necessary to utilize several different types of microphones for satisfactory results. Another objectional characteristic of prior brush beaters is the fact that the individual bristles or filaments are subject to whipping, i.e. flexing backwardly during the forward movement of the brushes which not only minimizes the amplitude of the sound produced but renders it slightly off beat or out of phase with the sounds being produced by other instruments. Moreover prior brushes are difficult to manipulate when playing rapid or the more difficult percussive techniques.

Other and serious shortcomings of prior brushes is the fact that the slender size of the filaments employed renders them subject to bending, distortion, twisting and breakage. This risk is so great that most brushes are utilized with hollow handles into which the bristles or filaments are retracted for safe storage when not in use. The need for these expendients renders the construction relatively complex and costly.

SUMMARY OF THE INVENTION

The foregoing and other disadvantages and shortcomings of brush type drum beaters are avoided by this invention. My improved drum stick comprises a bundle or cluster of similar wooden rods firmly secured together at one end to provide a handle and a precisely balanced beater. The remaining portion of the rods are free of restraint and generally uniformly grouped about the axis of the instrument. Accordingly, the free ends of the rods are relatively closely spaced apart and engagable with the surface of the percussion instrument or with an adjacent rod or rods. Preferably, the rods are of uniform cross section and very substantially larger in section than the filaments of prior brush type drum beaters. Accordingly, they are highly resistant to bending, flexing, whipping and injury from use or handling. The individual rods have very substantial resistance to flexing and strongly resist bending, twisting or breakage and can readily withstand rough usage in use as well as in handling. The rods are integral with and a part of the handle and there is no need for retraction of the free ends of the rods into a protective handle when not in use. The sound level generated by my improved and unique drum stick covers a wide range including that closely approximating prior brushes through and including levels many times greater. Moreover the produced sound is fuller and substantially more fleshy than that produced by prior brush-type drum sticks.

It is a primary object of the invention to provide an improved drum stick or beater formed of a cluster of wooden rods secured together at one end to form a handle.

Another object of the invention is to provide a bundle drum stick formed of a multiplicity of wooden rods highly resistant to whipping action prior to impact with the percussion instrument.

Another object of the invention is the provision of a bundle drum stick formed of a plurality of wooden rods effective upon impact with a percussion instrument to produce sound in a wide range of magnitudes.

Another object of the invention is the provision of a bundle drum stick formed of a multiplicity of wooden rods fixed to a handle at one end and with the free ends thereof clustered about the axis of the stick.

Another object of the invention is the provision of a bundle drum stick which is precisely balanced and manipulatable to produce a wide range of percussion sounds with ease and a minimum of effort.

These and other more specific objects will appear upon reading the following specification and claims and upon considering in connection therewith the attached drawing to which they relate.

Referring now to the drawing in which a preferred embodiment of the invention is illustrated:

Figure 1:
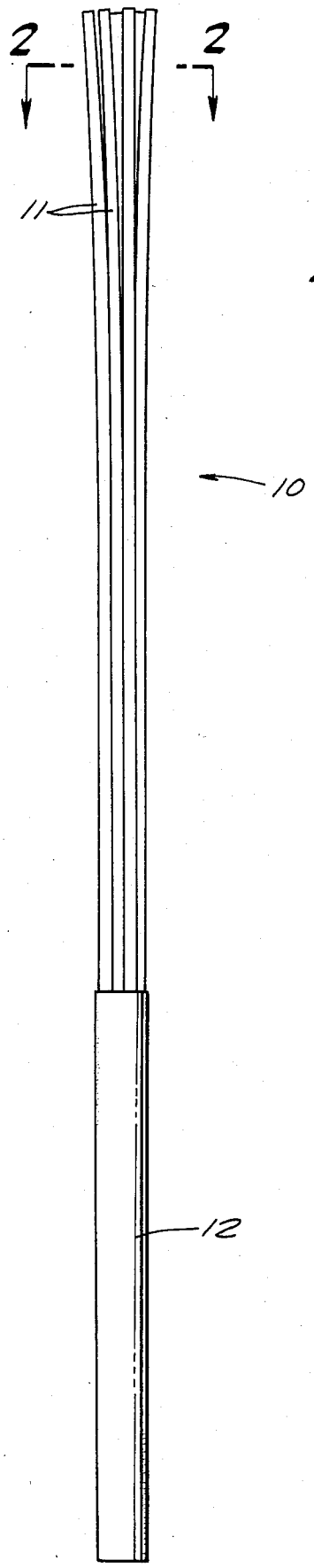
FIG. 1 is a side view of my bundle drum stick.
Figure 2:
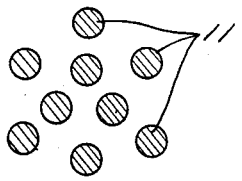
FIG. 2 is a cross sectional view taken along line 2—2 on FIG. 1.

Referring to FIGS. 1 and 2, there is shown an illustrative embodiment of my improved brush or drum stick 10 which is more conveniently designated a bundle drum stick. Typically, the stick comprises a multiplicity of similar wooden rods 11, 11 firmly secured together to form a handle 12. A suitable mode of forming the handle is to embed a selected portion of one end of rods 11 in plastic material for a length and in a diameter adequate to provide a precisely balanced drum stick. The remaining portion of the rods are free of restraint of any character and tend to flare slightly apart at their forward end in a pattern distributed uniformly about the axis of the stick as shown in FIG. 2.

Hardwood rods of approximately ⅛th inch diameter and 15 inches long are found highly satisfactory. Three different sizes have been found to satisfy the needs of most musical groups. A smaller size is illustrated in FIGS. 1 and 2 and employs 9 rods of ⅛th inch diameter. An intermediate size utilizes 13 rods of the same diameter whereas the largest size utilizes 9 3/16th inch diameter rods or 17⅛th inch rods. It will be understood that the number and size of the rods is not critical and that the foregoing specifications are suggestive and represent those found highly satisfactory.

In use this invention enables a musician to obtain a wide range as well as a wide variation in the nature and amplitude of percussion sounds including strong, full and fleshy sounds which are either soft and gentle or loud, vibrant and highly percussive depending upon the stroke mode and the force exerted by the musician. The precisely balanced characteristic of the stick enables a musician to play complicated and rapid percussion techniques.

While the particular bundle drum stick herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A bundle drum stick comprising a cluster of between 6 and 12 wooden rods having a length between 12 and 18 inches and a diameter between 0.100 and 0.187 inches firmly secured together only at one end to form a handle and with the remaining length thereof unrestrained but resistant to flexing while in movement in air toward contact with a percussion musical instrument.

2. A bundle drum stick comprising a cluster of similar wooden rods immovably secured together near one end to form a drum stick handle and the remaining length of said wooden rods being closely adjacent one another and resistant to flexing while in movement toward a percussion musical instrument and prior to contact therewith.

3. A bundle drum stick as defined in claim 2 characterized in that said wooden rods having a length ranging between 12 and 18 inches.

4. A bundle drum stick as defined in claim 3 characterized in that said wooden rods have a diameter ranging between about 0.100 and 0.187 inches.

5. A bundle drum stick comprising a cluster of similar elongated wooden rods secured together at one end to form a drum stick handle and the major length of said rods being free of restraint and usable as a sound generating musical device.

6. A bundle drum stick as defined in claim 5 characterized in that the handle end of said wooden rods are bonded together.

7. A bundle drum stick as defined in claim 5 characterized in that the handle end of said wooden rods is embedded in plastic material.

8. A bundle drum stick as defined in claim 5 characterized in that both ends of said bundle of wooden rods are generally cylindrical throughout the length thereof but the handle end of said bundle being of smaller diameter than the diameter of the opposite end of said bundle.

9. A bundle drum stick as defined in claim 5 characterized in that said handle is non-tubular and substantially free of voids.

10. A bundle drum stick as defined in claim 5 characterized in that said wooden rods are distributed generally uniformly about the axis of said drum stick from end-to-end thereof.

* * * * *